US012054300B2

(12) United States Patent
Monti

(10) Patent No.: US 12,054,300 B2
(45) Date of Patent: Aug. 6, 2024

(54) COUNTER-FILLER APPARATUS FOR COUNTING PHARMACEUTICAL ARTICLES AND FOR INSERTING THE ARTICLES INTERNALLY OF BOTTLES

(71) Applicant: MARCHESINI GROUP S.p.A., Pianoro (IT)

(72) Inventor: Giuseppe Monti, Pianoro (IT)

(73) Assignee: Marchesini Group S.P.A. (IT)

( * ) Notice: Subject to any disclaimer, the term of this patent is extended or adjusted under 35 U.S.C. 154(b) by 410 days.

(21) Appl. No.: 17/428,194

(22) PCT Filed: Mar. 2, 2020

(86) PCT No.: PCT/IB2020/051745
§ 371 (c)(1),
(2) Date: Aug. 3, 2021

(87) PCT Pub. No.: WO2020/178706
PCT Pub. Date: Sep. 10, 2020

(65) Prior Publication Data

US 2022/0119137 A1 Apr. 21, 2022

(30) Foreign Application Priority Data

Mar. 4, 2019 (IT) ..... 102019000003065

(51) Int. Cl.
*B65B 5/10* (2006.01)
*B65B 37/04* (2006.01)
(Continued)

(52) U.S. Cl.
CPC ..... *B65B 5/103* (2013.01); *B65B 37/04* (2013.01); *B65B 39/005* (2013.01); *B65B 43/52* (2013.01); *B65B 57/20* (2013.01)

(58) Field of Classification Search
CPC .. B65B 1/06; B65B 1/08; B65B 5/103; B65B 37/04; B65B 39/005; B65B 43/52; B65B 57/20
See application file for complete search history.

(56) References Cited

U.S. PATENT DOCUMENTS 3,152,622 A * 10/1964 Rothermel ..... B65B 39/14 141/181
4,146,123 A * 3/1979 Cottrell ..... B65G 47/1421 198/758
(Continued)

FOREIGN PATENT DOCUMENTS

DE 19505260 A1 8/1996
KR 20140124501 10/2014
WO WO 2014/098668 A1 6/2014

*Primary Examiner* — Gene O Crawford
*Assistant Examiner* — Kelvin L Randall, Jr.
(74) *Attorney, Agent, or Firm* — Endurance Law Group PLC

(57) ABSTRACT

Filler apparatus includes plural descent channels receiving pharmaceutical articles falling from transport channels of a vibrating conveyor. Sensors detect the articles inside the descent channels. A container has a mouth receiving the articles from the descent channels, a first chamber with a first discharge, a second chamber with a second discharge, and a separating wall dividing the mouth into a first entry section, for the first chamber, and a second entry section, for the second chamber. The wall is disposable either in a first position, wherein the entry sections can receive articles from an identical number of descent channels, and at least in a second position, wherein the entry sections can receive pharmaceutical articles from different numbers of descent channels.

6 Claims, 4 Drawing Sheets

(51) Int. Cl.

| | |
|---|---|
| ***B65B 39/00*** | (2006.01) |
| ***B65B 43/52*** | (2006.01) |
| ***B65B 57/20*** | (2006.01) |

(56) References Cited

U.S. PATENT DOCUMENTS

| | | | | |
|---|---|---|---|---|
| 5,522,512 | A * | 6/1996 | Archer | B65B 57/14 209/580 |
| 11,485,525 | B2 * | 11/2022 | Sala | B65B 39/12 |
| 2003/0034373 | A1 * | 2/2003 | Yuyama | B26F 3/002 83/167 |
| 2007/0118247 | A1 * | 5/2007 | Wooldridge | B65B 5/103 700/231 |
| 2013/0042943 | A1 * | 2/2013 | Bassani | B65B 57/20 700/242 |
| 2017/0287161 | A1 * | 10/2017 | Daniel Chan | B65G 47/26 |
| 2020/0317382 | A1 * | 10/2020 | Savoie-Lavigueur | B65B 1/30 |
| 2021/0284373 | A1 * | 9/2021 | Lebel | B65B 57/14 |

* cited by examiner

COUNTER-FILLER APPARATUS FOR COUNTING PHARMACEUTICAL ARTICLES AND FOR INSERTING THE ARTICLES INTERNALLY OF BOTTLES

FIELD OF THE INVENTION

The present invention relates to the technical sector relating to the filling of bottles with pharmaceutical or para-pharmaceutical articles, such as for example tablets, capsules, etc.

In particular, the present invention relates to a counter-filler apparatus for counting pharmaceutical articles and for subsequently inserting the articles internally of relative bottles.

DESCRIPTION OF THE PRIOR ART

It is known that each bottle must be filled with the exact number of pharmaceutical articles specified in order for it to be sold.

It is therefore necessary to proceed, before inserting the articles inside a relative bottle, to counting them.

In this regard, apparatuses are known, which in the sector are known as counters, for carrying out the count of the pharmaceutical articles that are to be inserted in a given number into a bottle, and then for inserting the articles into the bottle.

Pharmaceutical articles are usually accumulated inside a storage hopper while the bottles to be filled are advanced one following another along a conveying line, for example constituted by a screw conveyor.

To transport the pharmaceutical articles from the storage hopper to a filling area above the bottles advancing along the conveying line, a vibrating conveyor is used, which is provided with a series of transport channels having a "V" shape, into which the pharmaceutical articles exiting from the storage hopper are deposited.

The vibrating conveyor, with its vibrating motion, advances the pharmaceutical articles, deposited into the various transport channels, distancing them one from the others.

A known apparatus for carrying out the count of the pharmaceutical articles coming from the vibrating conveyor, and for the subsequent insertion thereof into bottles advancing along the conveying line, is done in the following way.

The known apparatus comprises a plurality of descent channels, each having an entry opening and an exit opening.

The descent channels are positioned in such a way that the entry openings are located immediately downstream of the transport channels of the vibrating conveyor so that the pharmaceutical articles, having passed beyond the end of the transport channels, can fall by force of gravity into the entry openings of the descent channels, and thus fall into the descent channels and be conveyed towards the exit opening.

The apparatus comprises sensor means, which are positioned so as to detect the pharmaceutical articles that fall internally of each descent channel, and which are configured in such a way as to provide the apparatus with a datum relative to the overall number of pharmaceutical articles present internally of the descent channels.

The apparatus comprises an accumulation chamber, generally having a funnel shape, arranged below the descent channels, which is predisposed to receive and accumulate the pharmaceutical articles exiting from the exit openings of the descent channels, up to the number necessary for the following insertion thereof into a relative bottle.

This accumulation chamber inferiorly comprises a discharge mouth for unloading the pharmaceutical articles accumulated internally thereof.

A hatch door is present and movable to open and close the discharge mouth.

The apparatus is also equipped with closing elements of the exit openings of the descent channels, which are activatable for closing the exit openings once there is the number of necessary number of pharmaceutical articles in the accumulation chamber to fill a bottle.

The apparatus is arranged in such a way that the discharge mouth of the accumulation chamber is located above the conveying line of the bottles.

Generally, there can be a tubular connecting element below the discharge mouth, to connect the discharge mouth with the mouth of a bottle which connecting element is positioned by the conveying line paused below the counter apparatus.

The hatch door at the discharge mouth is positioned in such a way as to keep the discharge mouth closed until there is the necessary number of pharmaceutical articles in the accumulation chamber to fill a bottle.

Then, as soon as the number of pharmaceutical articles necessary to fill the bottle has fallen into the accumulation chamber, the closing elements of the descent channels are activated to close the exit openings of the descent channels, while the hatch door is moved to open the discharge mouth and allow the pharmaceutical articles to fall into the bottle.

With this type of counter-filler apparatus, for increasing productivity, i.e. the number of bottles filled for a given time unit (for example per minute), one mode used is to intervene, by increasing the activating velocity of the vibrating conveyor, so as to be able to make a greater number of pharmaceutical articles fall into the descent channels.

This mode has seen to be substantially effective in the event that the number of pharmaceutical articles to be inserted in a bottle is quite high, for example greater than 50.

On the other hand, it has not been shown to be equally effective when the number of pharmaceutical articles is lower, for example 20-30.

In fact, in these cases, it is necessary to keep one or more of the descent channels closed, as otherwise a number of pharmaceutical articles would accumulate in the accumulation chamber that is greater than what is necessary during the pause time of the bottle beneath the counter apparatus.

Another mode at present used for the purposes of increasing the productivity consists in predisposing two or more counter-filler apparatuses, both made as described in the foregoing, one by the side of another, so that, while a first apparatus carries out the filling of a first bottle, a second apparatus can carry out the filling of a second bottle.

This mode however, as is clear, brings the need to predispose an adequate space for the positioning of the various counter apparatuses one flanked to the others, and is therefore disadvantageous in terms of size and optimisation of work spaces.

SUMMARY OF THE INVENTION

The aim of the present invention is therefore to provide a counter-filler apparatus for counting pharmaceutical articles and for inserting the articles internally of bottles, able to obviate the drawbacks present in the prior-art apparatuses described in the foregoing.

In particular, an aim of the present invention is to provide a new counter-filler apparatus able to efficiently carry out the count of pharmaceutical articles that are to be inserted in relative containers and at the same time to guarantee high productivity.

The above-cited aims are obtained by a counter-filler apparatus according to claim 1.

BRIEF DESCRIPTION OF THE DRAWINGS

The characteristics of a preferred, but not exclusive, embodiment of the counter-filler apparatus of the present invention will be described in the following with reference to the appended tables of drawings, in which.

DESCRIPTION OF THE PREFERRED EMBODIMENTS

Figure 1:
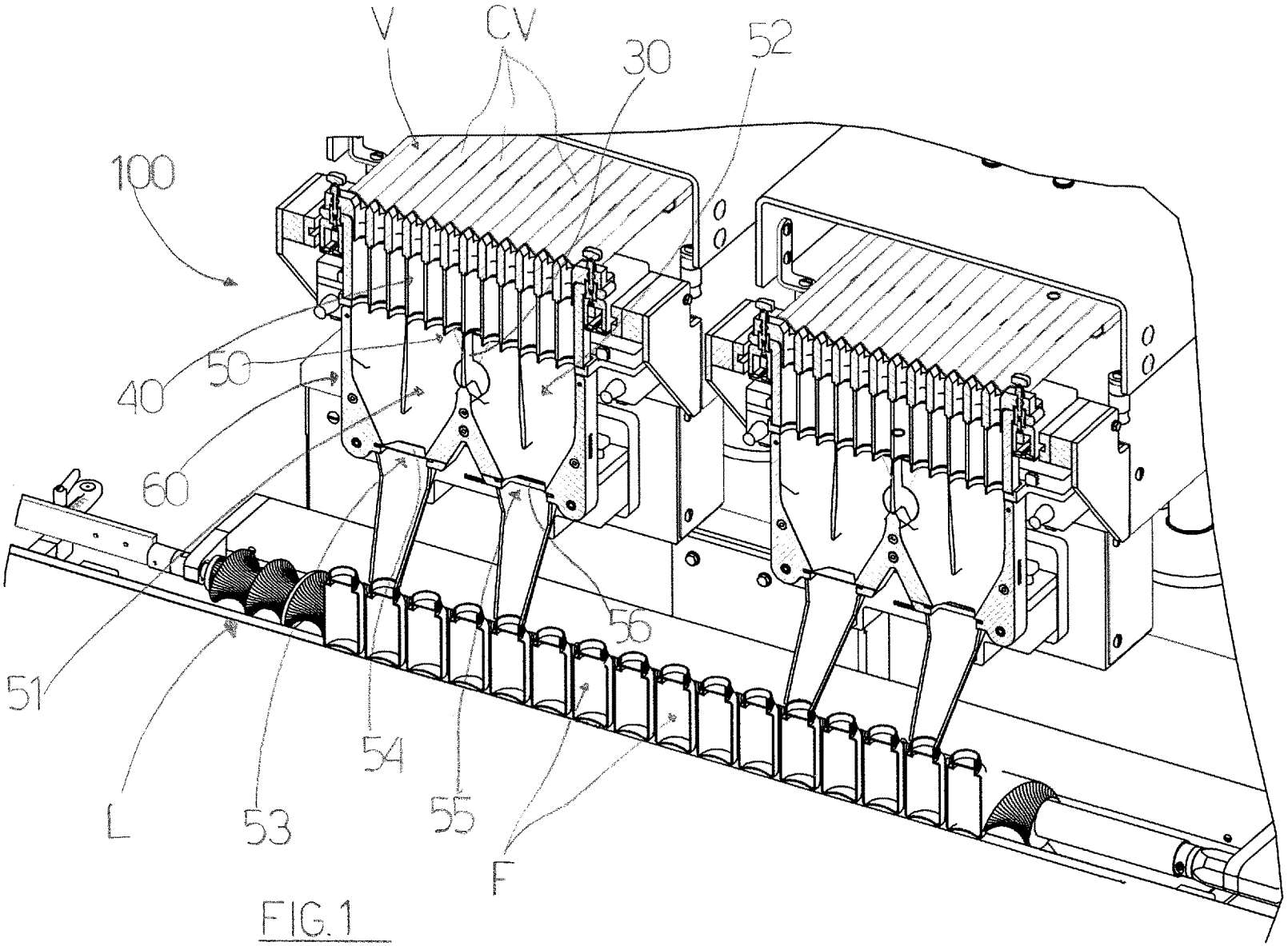
FIG. 1 schematically illustrates, in a perspective view partly-sectioned according to a vertical section plane, the counter-filler apparatus of the invention, positioned between a vibrating conveyor, which transports the pharmaceutical articles that are to be inserted in relative bottles, and a conveying line for conveying and pausing the bottles to be filled beneath the counter-filler apparatus.

With reference to the appended tables of drawings, reference numeral (100) denotes the counter-filler apparatus for counting pharmaceutical articles and for inserting the articles internally of bottles, of the present invention, in its entirety. The apparatus (100) is configured, as illustrated in particular in FIG. 1, to be positioned between a vibrating conveyor (V), having a plurality of transport channels (CV) for transport of rows of pharmaceutical articles, and a conveying line (L), for conveying bottles (F) which are to be filled with pharmaceutical articles. The apparatus (100) comprises a plurality of descent channels (40), each of which is conformed in such a way as to have an entry opening (41) and an exit opening (42).

The apparatus (100) is arranged with respect to the vibrating conveyor (V) so that the entry openings (41) of the descent channels (40) are positioned in such a way that the pharmaceutical articles, having passed beyond the end of the transport channels (CV) of the vibrating conveyor (V), can fall by force of gravity into the entry openings (41) of the descent channels (40), and thus fall into the descent channels (40) and be conveyed towards the exit openings (42).

For example, as illustrated in the figures, the vibrating conveyor (V) can be conformed in such a way as to have 12 transport channels (CV), and consequently the apparatus (100) of the invention will correspondingly have 12 descent channels (40).

Sensor means (S) are present, which are positioned so as to detect the pharmaceutical articles that fall internally of each descent channel (40).

The sensor means (S) are configured in such a way as to provide a datum relative to the number of pharmaceutical articles present internally of each descent channel (40).

The apparatus is equipped with a control unit (not illustrated in detail in the figures) which is interfaced with the sensor means (S) in such a way as to receive from the sensor means (S) the data relative to the number of pharmaceutical articles present internally of the various descent channels (40).

In this way, the control unit can calculate, in real time, the overall number of pharmaceutical articles present internally of all the descent channels, or internally of separate groups of descent channels.

The apparatus (100) further comprises an accumulation container (60), arranged below the descent channels (40) and having an entry mouth (50) for receiving the pharmaceutical articles exiting from the exit openings (42) of the descent channels (40).

The special characteristics of the apparatus (100) of the present invention consist in the fact that the accumulation container (60) is conformed in such a way as to comprise:

- a first accumulation chamber (51);
- a second accumulation chamber (52);
- a first discharge mouth (53), inferiorly of the first accumulation chamber (51), for example openable/closable by means of a first hatch door (54);
- a second discharge mouth (55), inferiorly of the second accumulation chamber (52), for example openable/closable by means of a second hatch door (56).

Further, the accumulation container (60) comprises a separating wall (30), arranged so as to mutually separate the first accumulation chamber (51) and the second accumulation chamber (52) in a zone in correspondence of the entry mouth (50) of the accumulation container (60) and beneath the exit openings (42) of the descent channels (40).

The separating wall (30) thus divides the entry mouth (50) into a first entry section (5A), for the first accumulation chamber (51), and a second entry section (5B), for the second accumulation chamber (52).

In this way, the first entry section (5A) can receive pharmaceutical articles in exit from the exit openings (42) of a first group (A) of the descent channels (40) and the first accumulation chamber (51) can thus store pharmaceutical articles, coming from this first group (A) of descent channels (40), while the second entry section (5B) can receive pharmaceutical articles in exit from the exit openings (42) of a second group (B) of the descent channels (40) and the second accumulation chamber (52) can consequently store pharmaceutical articles coming from the second group (B) of descent channels (40).

With this particular conformation of the accumulation container (60), pharmaceutical articles to be unloaded into a first bottle (F1) positioned, paused from the conveying line (L), beneath the first discharge mouth (53), can be accumulated internally of the first accumulation chamber (51), while, at the same time, pharmaceutical articles to be unloaded into a second bottle (F2) positioned, paused from the conveying line (L), beneath the second discharge mouth (55) can be accumulated internally of the second accumulation chamber (52).

Therefore, with a single apparatus (100) it is possible to carry out the contemporaneous filling of two bottles, after having carried out the counting of the pharmaceutical articles to be inserted in each thereof.

Normally, during the accumulating operations of the pharmaceutical articles in the two accumulation chambers (51, 52), the first hatch door (54) is maintained in a closing position of the first discharge mouth (53), while, in turn, the second hatch door (56) is maintained in a closing position of the second discharge mouth (55).

As soon as the requested number of pharmaceutical articles has been reached in the two accumulation chambers (51, 52), the first hatch door (54) and the second hatch door (56) are moved into an opening position of the first discharge mouth (53) and the second discharge mouth (55), so that the pharmaceutical articles present in the first accumulation chamber (51) can fall into the first bottle (F1), while the pharmaceutical articles present in the second accumulation chamber (52) can fall into the second bottle (F2).

A first connecting element (R1) can be present, to connect the first discharge mouth (53) with the mouth of the first bottle (F1) and guide the pharmaceutical articles internally of the first bottle (F1), and a second connecting element (R2) can be present, to connect the second discharge mouth (55) with the mouth of the second bottle (F2) and guide the pharmaceutical articles internally of the second bottle (F2).

Figure 2:
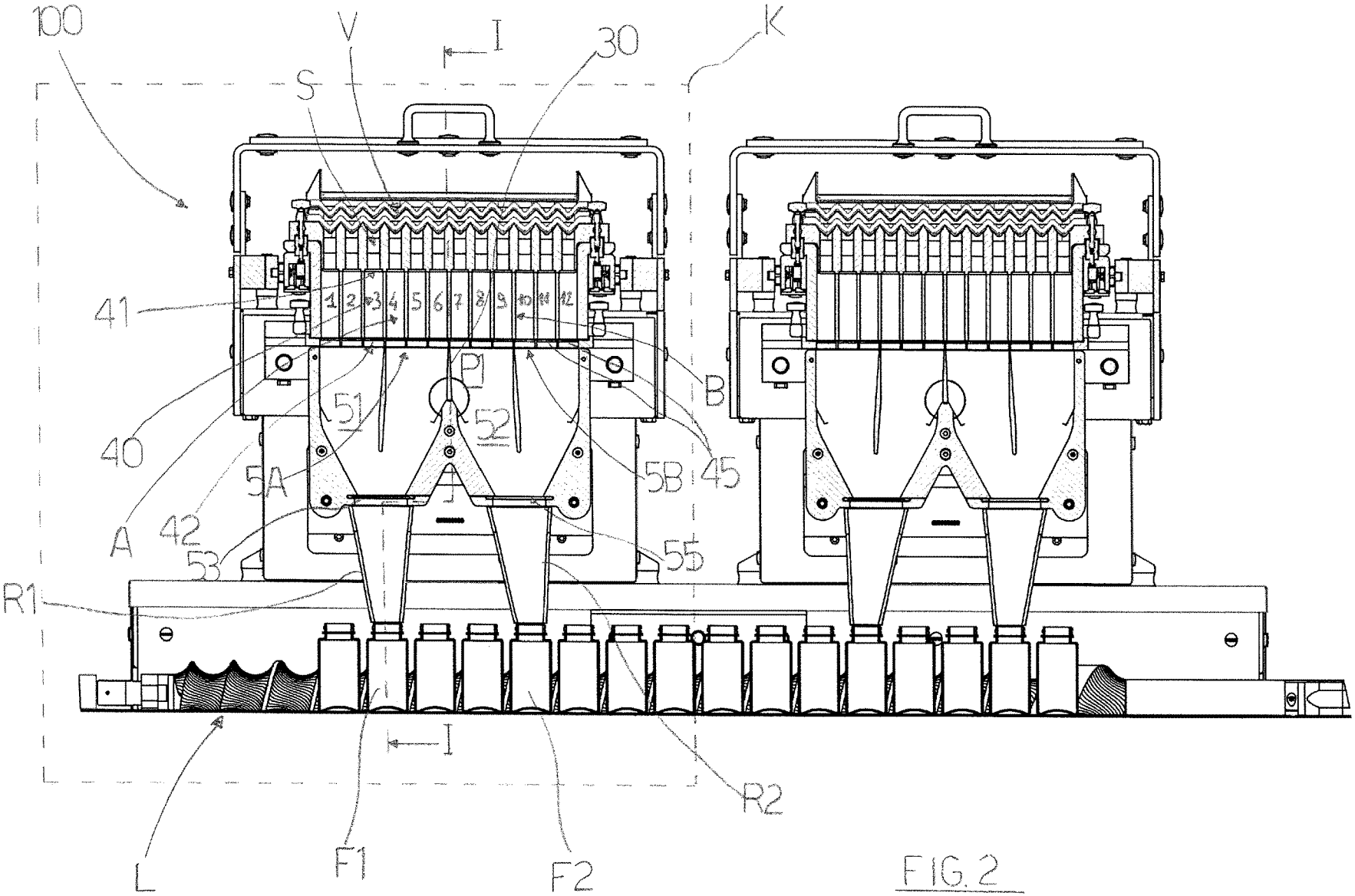
FIG. 2 is a front view of the apparatus of FIG. 1, with the apparatus in a first possible operating configuration.
Figure 3B:
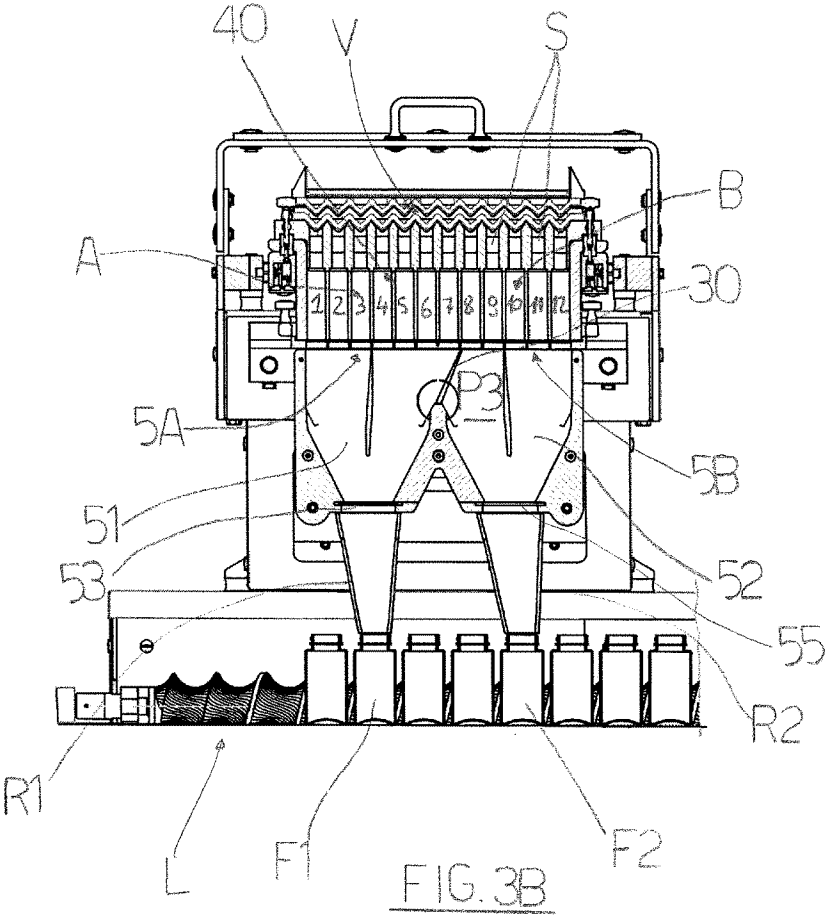
FIG. 3B illustrates the detail denoted by reference K of FIG. 2, with the apparatus in a further third possible operating configuration.
Figure 3A:
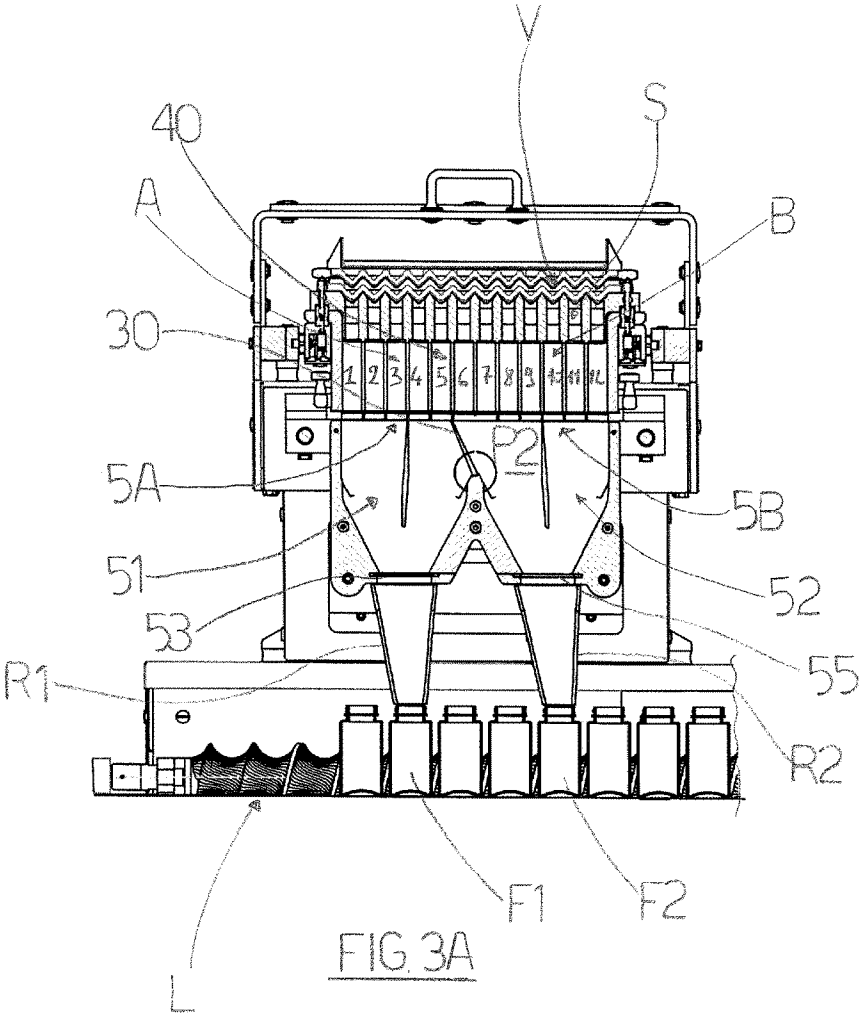
FIG. 3A illustrates the detail denoted by reference K of FIG. 2, with the apparatus in a second possible operating configuration.

A further special aspect of the apparatus (100) of the invention consists in the fact that the separating wall (30) is mounted so as to be movable with respect to the exit openings (42) of the descent channels (40) so as to be positionable either:

in a first position (P1) (see for example FIGS. 1 and 2), in which the separating wall (30) is positioned so that the first entry section (5A) and the second entry section (5B) can receive pharmaceutical articles from an identical number of descent channels (40), and at least in a second position (P2, P3), in which the separating wall (30) is positioned so that the first entry section (5A) and the second entry section (5B) can receive pharmaceutical articles from a different number of descent channels (40) (see for example FIGS. 3A and 3B).

This peculiarity enables dynamic and instantaneous intervention in a case where there is an imbalance in the number of pharmaceutical articles which are accumulating, or which are about to fall into the two accumulation chambers.

Generally, for the operation of the apparatus (100), the separating wall (30) is maintained in the first position (P1) so that the two accumulation chambers (51, 52) can be contemporaneously supplied by an equal number of descent channels (40).

This position for the separating wall (30) is maintained until the control unit, on the basis of information received from the sensor means (S), detects a balanced filling between the two accumulation chambers, i.e. they are substantially receiving, in equal measure, the pharmaceutical articles in exit from the descent channels (40), and therefore they are filling with the same number of pharmaceutical articles.

This enables carrying out the discharge of the articles from the two accumulation chambers into the two bottles at the same time.

However, there is no certainty that the ideal situation described in the foregoing can be repeated identically over a period of time.

In fact, it can occur that there is no uniform and constant fall of pharmaceutical articles from the vibrating channels (CV) of the vibrating conveyor (V) internally of the various descent channels (40).

It can indeed occur that over a certain period of time a same number of pharmaceutical articles does not fall into the descent channels.

Consequently, over a certain time, a number of pharmaceutical articles has fallen, or is falling, into the first accumulation chamber (51) from the first group (A) of descent channels (40) which number is greater (or vice versa, is smaller) than a number of pharmaceutical articles which has fallen, or is falling from the second group (B) of descent channels (40), into the second discharge chamber (52).

In these cases, an imbalance in the filling of the two accumulation chambers is taking place, which, if maintained up to the completion of the counting of the number of pharmaceutical articles required for the filling of the bottles, would lead to a delay in unloading into the second bottle, or the first bottle.

Therefore, each time the control unit, on the basis of information received from the sensor means (S), detects an imbalance in the filling of the two accumulation chambers, it will be able to intervene to move the separating wall (30) and position it in a position in which it can compensate for the imbalance in the filling of the two accumulation chambers (51, 52).

For example, if it is detected that in the first accumulation chamber (51) there is an accumulation or a falling, of a number of pharmaceutical articles greater than the number of pharmaceutical articles which is accumulating in, or falling, into, the second accumulation chamber (52), the control unit will intervene to displace the separating wall (30) and position it in a second position (P2) in which the second entry section (5B) of the second accumulation chamber (52) can receive articles from a greater number of descent channels (40) with respect to the first entry section (5A) of the first accumulation chamber (51).

Vice versa, if the control unit detects that in the first accumulation chamber (51) there is an accumulation in or a falling into, of a number of pharmaceutical articles that is smaller than the number of pharmaceutical articles which is accumulating in, or falling into, the second accumulation chamber (52), the control unit will intervene to displace the separating wall (30) and position it in a third position (P3) in which the first entry section (5A) of the first accumulation chamber (51) can receive articles from a greater number of descent channels (40) with respect to the second entry section (5B) of the second accumulation chamber (52).

For example, in the preferred embodiment illustrated in the figures of the drawings, as mentioned in the foregoing, the apparatus (100) comprises 12 descent channels (40) (numbered in FIGS. 2, 3A and 3B from 1 to 12), for receiving pharmaceutical articles coming from a vibrating conveyor (V) having 12 transport channels (CV).

In this case, in general, the separating wall (30) is positioned in a first position (P1) (see FIG. 2), so that it divides the entry mouth (50) of the accumulation container (60) into two equal parts, i.e. that for the first entry section (5A) of the first accumulation chamber (51) there is a first group (A) of 6 descent channels (40) dedicated thereto, and that for the second entry section (5B) of the second accumulation chamber (52) there is a second group (B) of 6 descent channels (40) dedicated thereto.

In practice, the separating wall (30) is positioned between the 6th and 7th descent channel (40), so that the exit openings (42) of 6 descent channels can discharge the pharmaceutical articles that have fallen therein into the first accumulation chamber (51) and that the exit openings (42) of 6 descent channels can unload the pharmaceutical articles that have fallen therein into the second accumulation chamber (52).

With this configuration for the separating wall (30), the two accumulation chambers are supplied by a same number of descent channels (6 descent channels each) so there is a balanced filling as long as there is uniform falling of pharmaceutical articles from the vibrating conveyor into the various descent channels.

If the sensor means (S) detect that into the first group (A) of 6 descent channels (40), dedicated to the filling of the first accumulation chamber (51), a greater number of pharmaceutical articles has fallen with respect to the number of pharmaceutical articles that has fallen into the second group (B) of 6 descent channels (40), dedicated to the filling of the second accumulation chamber (52), the control unit will be able to process a datum informing that a greater number of pharmaceutical articles is accumulating in the first accumulation chamber (51) with respect to the second accumulation chamber (52).

Consequently the control unit can intervene to displace the separating wall (30) and position it in a second position (P2) (see FIG. 3A), so as to reduce the first entry section (5A) of the first accumulation chamber (51) and increase the second entry section (5B) of the second accumulation chamber (52), i.e. position the separating wall (30) in a second position (P2) in which the first entry section (5A) will have 5 dedicated descent channels (40) and the second entry section (5B) will have 7 dedicated descent channels (40).

In practice, the separating wall (30) is displaced into a second position (P2) in which it goes into a position between the 5th and 6th descent channel, so that the exit opening of the 6th descent channel can supply the second accumulation chamber (52) instead of the first accumulation chamber (51).

In this way, the second accumulation chamber (52) can receive pharmaceutical articles from a greater number of descent channels (40) with respect to the first accumulation chamber (51) and thus recuperate the delay in the number of articles that are accumulating therein.

Vice versa, if the sensor means (S) detect that, a smaller number of pharmaceutical articles has fallen into the first group (A) of 6 descent channels (40), dedicated to the filling of the first accumulation chamber (51), with respect to the number of pharmaceutical articles that has fallen into the second group (B) of 6 descent channels (40), dedicated to the filling of the second accumulation chamber (52), the control unit will be able to process a datum informing that a smaller number of pharmaceutical articles is accumulating in the first accumulation chamber (51) with respect to the second accumulation chamber (52).

Consequently the control unit can intervene to displace the separating wall (30) and position it in a third position (P3) (see FIG. 3B) so as to increase the first entry section (5A) of the first accumulation chamber (51) and reduce the second entry section (5B) of the second accumulation chamber (52), i.e. position the separating wall (30) in a third position (P3) in which the first entry section (5A) will have 7 dedicated descent channels (40) and the second entry section (5B) will have 5 dedicated descent channels (40).

In practice, the separating wall (30) is displaced into a third position (P3) in which it goes into a position between the 6th and 7th descent channel, so that the exit opening of the 7th descent channel can supply the first accumulation chamber (51) instead of the second accumulation chamber (52).

In this way, the first accumulation chamber (51) can receive pharmaceutical articles from a greater number of descent channels with respect to the second accumulation chamber (52) and recuperate the delay in the number of articles that are accumulating therein.

From the above, it is clear that the apparatus (100) of the invention enables carrying out the filling of two bottles, and therefore gives high productivity.

At the same time, it enables carrying out the filling of the two bottles contemporaneously, owing to the special conformation of the accumulation container, with the two accumulation chambers, and the presence of the separating wall that is movable to increase or reduce the inlet sections of the two accumulation chambers, and therefore the number of descent channels dedicated thereto, which enables real-time balancing of the filling of the two accumulation chambers.

Other further advantageous characteristics of the apparatus of the invention are described in the following.

Figure 4:
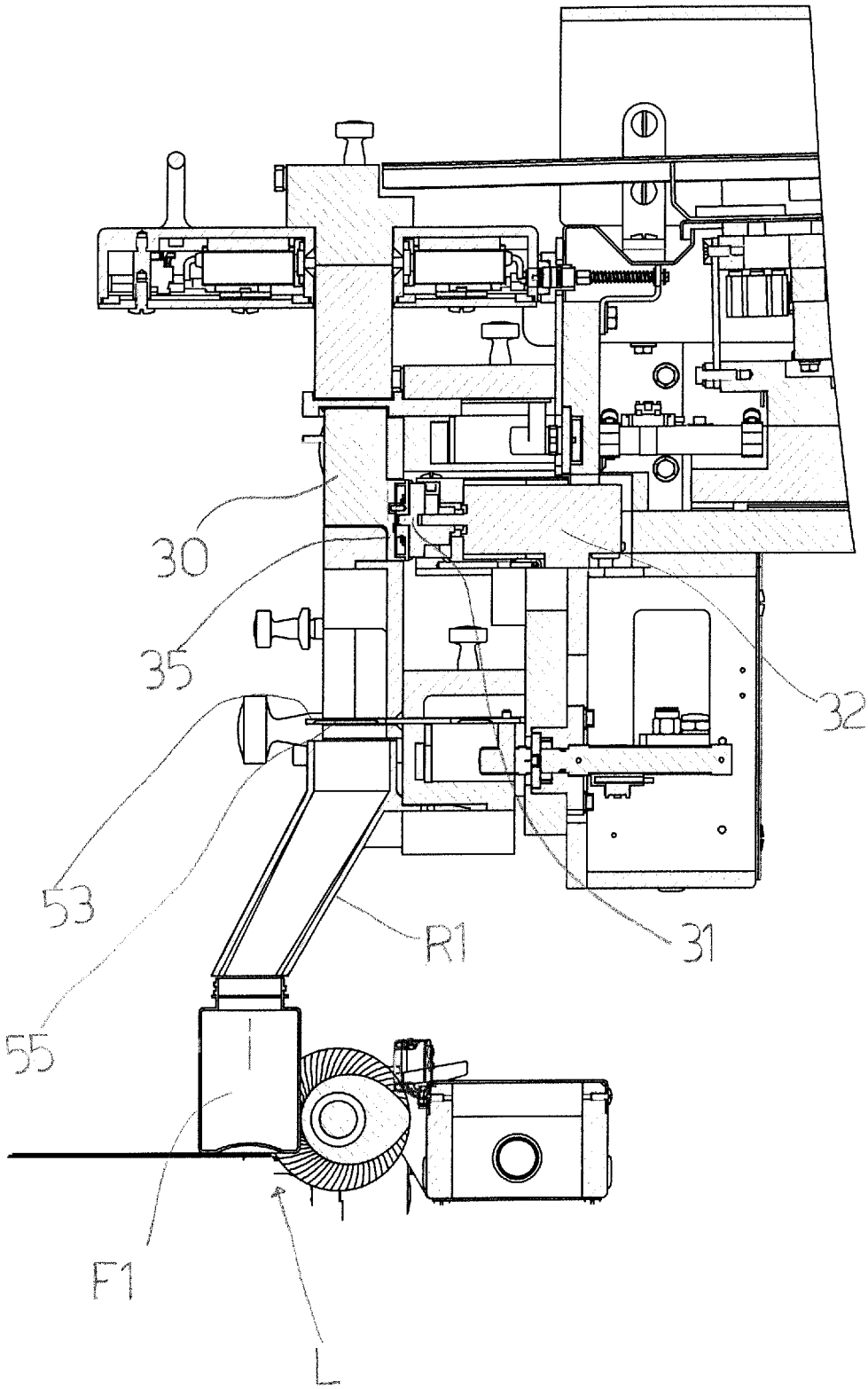
FIG. 4 is the view along section plane Hof FIG. 2.

The separating wall (30) is preferably predisposed to be set in rotation about a rotation axis. For example, in the preferred embodiment illustrated in the figures of the drawings, in particular in FIG. 4, the separating wall (30) is mounted on a collar (35) coupled to a shaft (31) predisposed so that a part thereof is external of the accumulation container (60). Motor means (32) are also provided, for activating the shaft (31) in rotation.

The apparatus (100) further comprises closing elements (45) coupled to the exit openings (42) of the various descent channels (40), which are activatable to close the exit openings (42) of the descent channels (40) once the number of pharmaceutical articles required to fill the two bottles has fallen into the two accumulation chambers.

Thus, once the number of pharmaceutical articles required to fill both bottles have fallen into both accumulation chambers located paused in the conveying line beneath the two discharge mouths, the closing elements are activated to close the exit openings of the descent channels, so as to prevent the fall of further pharmaceutical articles into the two accumulation chambers, while the two hatch doors associated to the two discharge mouths are activated to open the two discharge mouths and enable discharge of the pharmaceutical articles from the two accumulation chambers into the two bottles, via the two connecting elements, if present.

Once the filling of the two bottles has been carried out, the two hatch doors will be newly activated to close the two discharge mouths, the closing elements will be activated to open the exit openings of the descent channels in order to proceed to a new filling of the two accumulation chambers, while the conveying line will be activated to position another two empty bottles beneath the two discharge mouths. According to production needs, a plurality of apparatuses can be positioned as described in the foregoing, one flanked to another, such as for example illustrated in the appended figures of the drawings, where two counter-filler apparatuses according to the invention are illustrated, positioned flanked to one another, above a single conveying line of bottles. Each apparatus will thus be predisposed to receive pharmaceutical articles coming from two vibrating conveyors, and to fill two respective bottles: in this way it is possible to contemporaneously fill four bottles for each pause of the conveying line.

The invention claimed is:

1. A counter-filler apparatus for counting pharmaceutical articles and for inserting the articles internally of bottles, configured to be positioned between a vibrating conveyor, having a plurality of transport channels for transport of rows of pharmaceutical articles, and a conveying line, for conveying bottles which are to be filled with pharmaceutical articles, comprising:

a plurality of descent channels, each of which having an entry opening and an exit opening, wherein the apparatus is arranged with respect to the vibrating conveyor so that the entry openings of the descent channels are positioned in such a way that the pharmaceutical articles, having passed beyond an end of the transport channels of the vibrating conveyor, can fall by force of gravity into the entry openings of the descent channels, and thus fall into the descent channels and be conveyed towards the exit openings;

sensor means, which are positioned so as to detect the pharmaceutical articles that fall internally of each descent channel, and which are configured in such a way as to provide a datum relative to a quantity of pharmaceutical articles present internally of each descent channel;

an accumulation container, arranged below the descent channels and having an entry mouth for receiving the pharmaceutical articles exiting from the exit openings of the descent channels, wherein the accumulation container is conformed in such a way as to comprise:

a first accumulation chamber;

a second accumulation chamber;

a first discharge mouth below of the first accumulation chamber;

a second discharge mouth below of the second accumulation chamber;

a separating wall, arranged so as to mutually separate the first accumulation chamber and the second accumulation chamber in a zone in correspondence of the entry mouth of the accumulation container and beneath the exit openings of the descent channels, and divide the entry mouth into a first entry section, for the first accumulation chamber, and a second entry section, for the second accumulation chamber, so that the first entry section can receive pharmaceutical articles in exit from the exit openings of a first group of the descent channels and the first accumulation chamber can store pharmaceutical articles, and the second entry section can receive pharmaceutical articles in exit from the exit openings of a second group of the descent channels and the second accumulation chamber can store pharmaceutical articles, so that pharmaceutical articles to be unloaded into a first bottle position, paused from the conveying line, beneath the first discharge mouth can be accumulated internally of the first accumulation chamber, and pharmaceutical articles to be unloaded into a second bottle position, paused from the conveying line, beneath the second discharge mouth can be accumulated internally of the second accumulation chamber, the separating wall being mounted so as to be movable with respect to the exit openings of the descent channels so as to be positionable either:

in a first position, in which the separating wall is positioned so that the first entry section and the second entry section can receive pharmaceutical articles from an identical number of descent channels, and at least in a second position, in which the separating wall is positioned so that the first entry section and the second entry section can receive pharmaceutical articles from a different number of descent channels.

2. The apparatus of claim 1, wherein the separating wall is movable with respect to the exit openings of the descent channels so as to be positionable in a second position, in which the separating wall is positioned so that the first entry section, and therefore the first accumulation chamber, can receive articles from a smaller number of descent channels with respect to the second entry section, and therefore with respect to the second accumulation chamber, and in which the separating wall is also movable so as to be positionable in a third position in which the separating wall is positioned so that the first entry section, and therefore the first accumulation chamber, can receive articles from a greater number of descent channels with respect to the second entry section, and therefore with respect to the second accumulation chamber.

3. The apparatus of claim 1, wherein the separating wall is predisposed to be set in rotation about a rotation axis.

4. The apparatus of claim 3, wherein the separating wall is mounted on a collar coupled to a shaft predisposed so that a part thereof is external of the accumulation container and it comprises motor means, for activating the shaft in rotation.

5. The apparatus of claim 1, wherein the first discharge mouth is openable/closable by means of a first hatch door, and wherein the second discharge mouth is openable/closable by means of a second hatch door.

6. The apparatus of claim 1, further comprising closing elements activatable to close the exit openings of the descent channels.

* * * * *